US007367332B2

(12) United States Patent
Mosher, II et al.

(10) Patent No.: US 7,367,332 B2
(45) Date of Patent: May 6, 2008

(54) FOLDING CAMPING STOVE

(75) Inventors: Robert F. Mosher, II, Wichita, KS (US); Stuart L. Meether, Wichita, KS (US); Mitchell L. Wilgus, Andover, KS (US); Joshua M. Wright, Hoboken, NJ (US)

(73) Assignee: The Coleman Company, Inc., Wichita, KS (US)

( * ) Notice: Subject to any disclaimer, the term of this patent is extended or adjusted under 35 U.S.C. 154(b) by 394 days.

(21) Appl. No.: 11/122,843

(22) Filed: May 5, 2005

(65) Prior Publication Data

US 2005/0268902 A1 Dec. 8, 2005

Related U.S. Application Data

(60) Provisional application No. 60/577,418, filed on Jun. 4, 2004.

(51) Int. Cl.
*F24C 1/16* (2006.01)
*F24C 5/20* (2006.01)

(52) U.S. Cl. ..... 126/9 R; 126/38

(58) Field of Classification Search ..... 126/9 R, 126/9 B, 25 R, 41 R, 50, 39 B, 39 E; 219/450.1; 99/372; D7/334
See application file for complete search history.

(56) References Cited

U.S. PATENT DOCUMENTS

| | | | | |
|---|---|---|---|---|
| 1,133,491 | A | 3/1915 | Moats | |
| 1,143,581 | A | 6/1915 | Gates | |
| 1,654,662 | A | 3/1928 | Nielsen et al. | |
| 1,721,445 | A | 7/1929 | Hall | |
| 1,775,165 | A | 9/1930 | Horsrud et al. | |
| 1,991,135 | A | 2/1935 | Brown | |
| 2,209,677 | A * | 7/1940 | Flamm | 99/339 |
| 2,742,893 | A * | 4/1956 | Keffer | 126/38 |
| 2,860,224 | A | 11/1958 | Tammen | |
| 3,692,013 | A | 9/1972 | Grafton et al. | |
| 3,713,432 | A | 1/1973 | Finley | |
| 3,789,821 | A | 2/1974 | Fick et al. | |
| D328,547 | S | 8/1992 | Dutro et al. | |
| 5,363,748 | A * | 11/1994 | Boehm et al. | 99/372 |
| 5,954,044 | A | 9/1999 | Schmidt et al. | |
| 6,369,366 | B1 | 4/2002 | Mullen | |
| 6,555,795 | B2 * | 4/2003 | Glucksman et al. | 219/450.1 |

OTHER PUBLICATIONS

Search Report Under R. 44 or R. 45 EPC by the European Patent Office in related application (Nov. 18, 2005).

* cited by examiner

*Primary Examiner*—Steve McAllister
*Assistant Examiner*—Sarah E. Suereth
(74) *Attorney, Agent, or Firm*—Townsend and Townsend and Crew LLP

(57) ABSTRACT

A folding camping stove. The folding camping stove may be formed in a clamshell configuration, having two clamshells that fold outward to expose at least two cooking surfaces. Two pivot points are provided on the folding camping stove. Each of the clamshells folds about a separate pivot point. Fuel trains for the clamshells are positioned at the pivot points. A regulator and manifold assembly is provided for providing gas from a canister to the folding stove. The manifold splits the gas coming from the regulator and directs it to opposite sides of the folding stove. Each of the clamshells includes a cooking grate. The cooking grates appear symmetrical from a top view, but are slightly offset relative to one another so that the clamshells may be folded inward relative to each other and the grates may nest together.

4 Claims, 6 Drawing Sheets

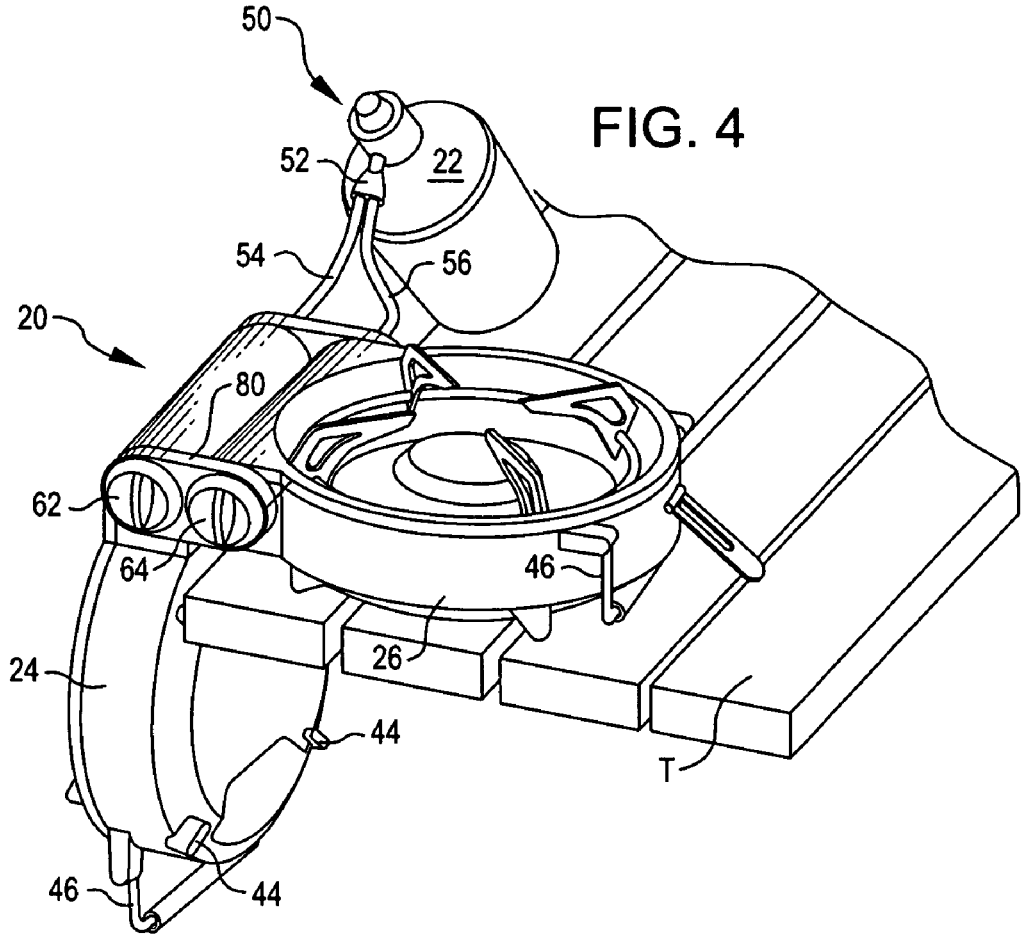
FIG. 4
FIG. 6
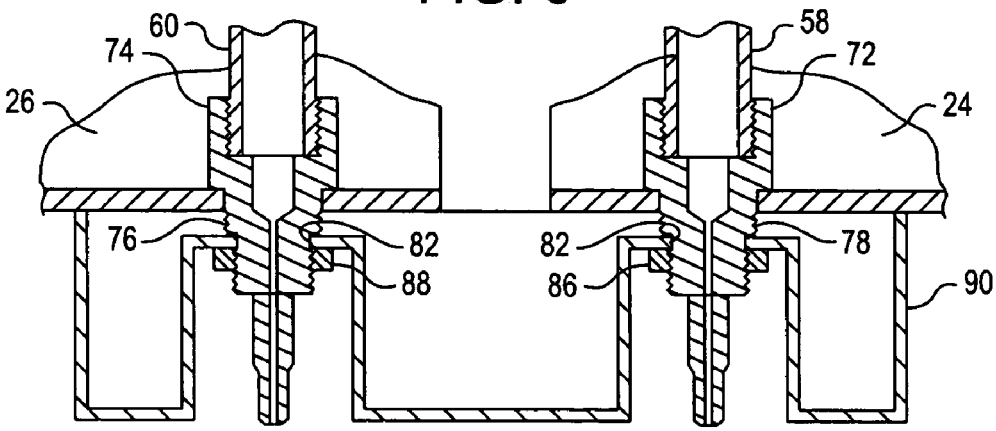

FOLDING CAMPING STOVE

REFERENCE TO RELATED APPLICATION

This application claims the benefit of U.S. Provisional Application No. 60/577,418, filed Jun. 4, 2004, and incorporated herein by reference.

TECHNICAL FIELD OF THE INVENTION

The present invention relates to stoves, and more specifically to portable stoves.

BACKGROUND OF THE INVENTION

Portable stoves are popular cooking appliances, especially for use while camping or picnicking. Portable stoves commonly are powered by combustible gasses, such as propane gas. A typical portable stove includes a stove frame, one or more burner assemblies arranged in the frame, and a gas supply, such as a gas canister, coupled to the burner assembly via a control valve. Smaller versions convenient for backpacking may be not much larger than the gas canister itself, while larger versions designed for group camping may be the size of a large briefcase.

Larger portable stoves typically are designed to rest on a picnic table and open and close in a manner similar to that of a hard-sided suitcase. As with a suitcase, there may be a handle in the middle of the long, narrow front panel for carrying the portable stove in the closed position.

While these larger, suitcase-style portable stoves work well for their intended purpose, there are some limitations to their use. Generally, the suitcase-style portable stoves require a separate table on which to rest, and must be level or near level on that table. In addition, although the suitcase-style portable stoves fold into a box configuration, they are still somewhat bulky for travel and storage. Care must be taken with the devices because there are often objects that extend outside the box configuration, such as gas line attachments or control knobs, which may need protection during storage and/or transport.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

A folding camping stove is provided. In an embodiment, the folding camping stove is formed in a clamshell configuration, having two clamshells that fold outward to expose at least two cooking surfaces.

In accordance with an embodiment, two pivot points are provided on the folding camping stove. Each of the clamshells folds about a separate pivot point. In an embodiment, fuel trains for the two clamshells are positioned at the pivot points.

A regulator and manifold assembly is provided for providing gas from a canister to the folding stove. The manifold splits the gas coming from the regulator and directs it to opposite sides of the folding stove. In an embodiment, the manifold directs fuel to two fuel trains, one each positioned at the two pivot points. Each fuel train may include a fuel conduit that extends the width of the stove and about which the respective clamshell rotates.

The separate fuel trains and the manifold and regulator assembly provide a single regulator system that is capable of providing fuel to two opposite sides of the folding stove. In addition, the separate fuel trains permit the folding stove to be configured without having a fuel line crossing either pivot location, which permits the folding stove to be manufactured without the need for a flexible fuel line extending through the two pivot points. Moreover, in accordance with an embodiment, the clamshells pivot along their fuel trains, and the couplings attach at the pivot points.

In an alternate embodiment, a single fuel line connects to a linkage between the two clamshells, and fuel systems for the separate clamshells are connected to the linkage. At least one of the fuel systems is capable of rotation relative to the linkage without fuel loss, and may utilize, for example, o-ring connections to allow leak-proof rotation.

In accordance with an embodiment, each of the clamshells includes a cooking grate. The cooking grates appear symmetrical from a top view, but are slightly offset relative to one another so that the clamshells may be folded inward relative to each other and the grates may nest together. In this manner, more compact folding of the folding stove is provided.

In accordance with an embodiment, the folding stove is narrower at a central portion of the stove at which the fuel trains are located. The body of the clamshells extends outward beyond the central portion, and control knobs or any other features extending from this central section are protected by the remainder of the clamshells extending beyond these features.

Other features of the invention will become apparent from the following detailed description when taken in conjunction with the drawings, in which:

BRIEF DESCRIPTION OF THE DRAWINGS

FIG. 4 is a side perspective view of the folding stove of FIG. 1, with the stove opened more than 180 degrees;

FIG. 6 is a cross-sectional view taken along the section lines 6-6 of FIG. 3;

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
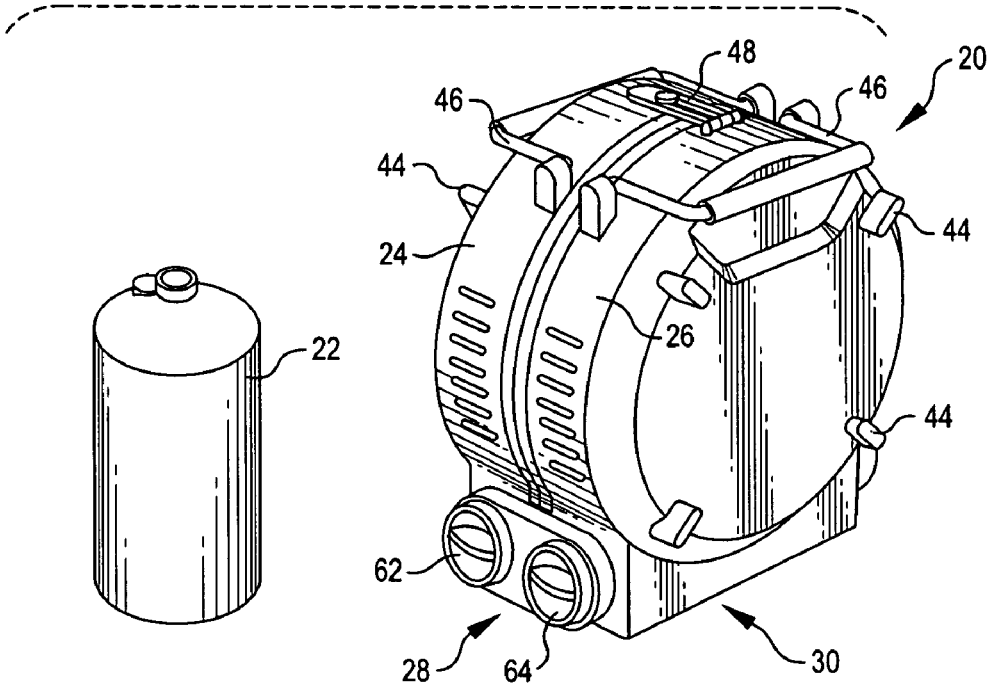
FIG. 1 is a side perspective view of a folding stove in accordance with an embodiment of the invention.

Referring now to the drawings, in which like reference numerals represent like parts throughout the several views, FIG. 1 shows a folding stove 20 in accordance with an embodiment of the invention. The folding stove 20 is designed for use with combustible gasses, such as propane gas, and may be provided fuel by, for example, a gas canister 22.

Figure 2:
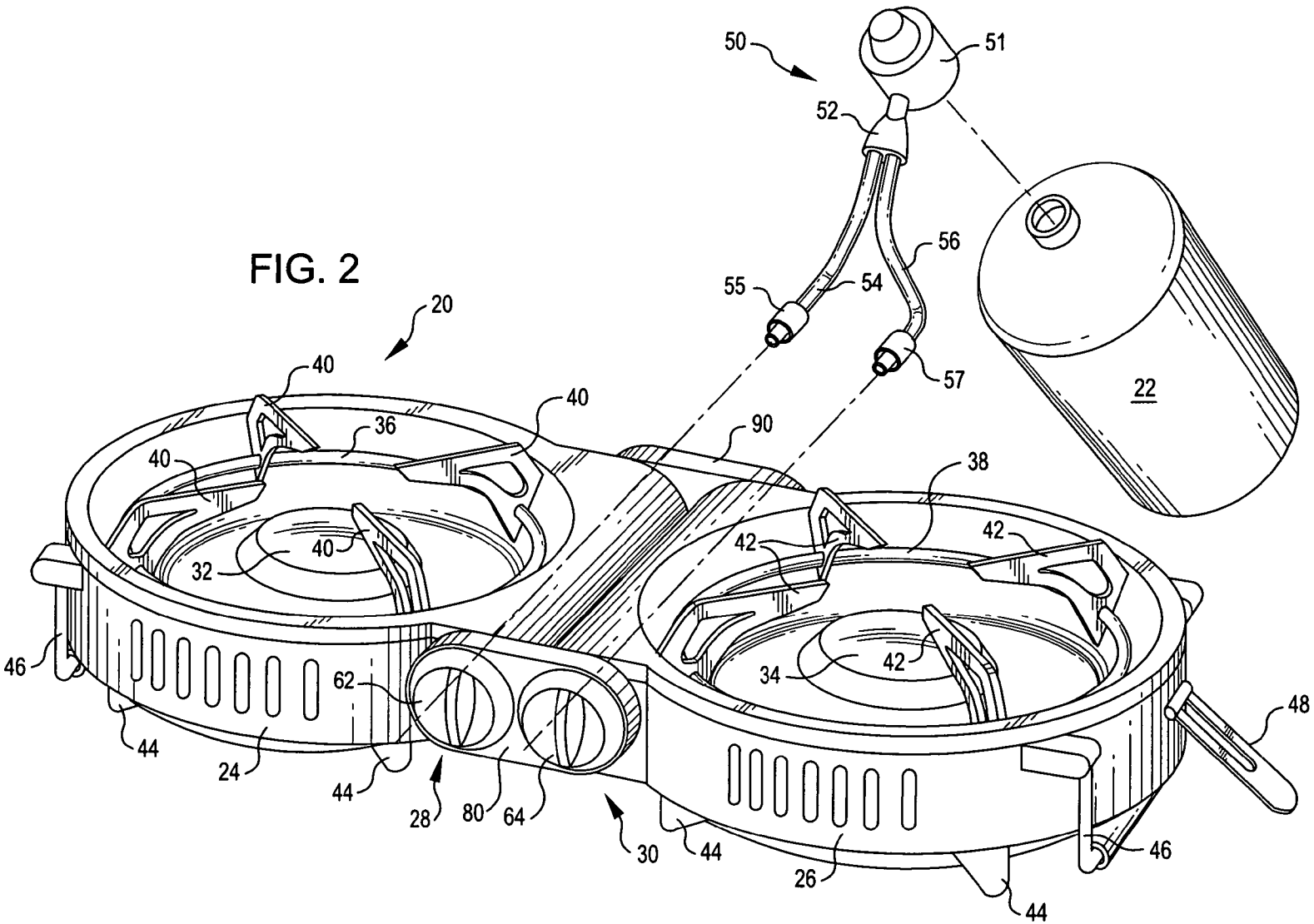
FIG. 2 is a side perspective view of the folding stove of FIG. 1, folded outward into an open configuration.

In accordance with an embodiment, the folding stove 20 includes two clamshells 24, 26. In a first configuration shown in FIG. 1, the two clamshells 24, 26 are folded together in a storage configuration. As can be seen in FIG. 2, the two clamshells 24, 26 may be rotated outward about two pivot points, in the embodiment shown, two fuel trains 28, 30, so that the folding stove 20 is in an opened configuration. In the opened configuration, burner eyes 32, 34, one each in the two clamshells 24, 26, are exposed as cooking surfaces.

By "fuel trains," we mean the conduit system through which fuel flows to the burner eyes 32, 34. The numbers 28 and 30 (e.g., FIG. 2) in the drawings point generally to the area where these are located in the shown embodiment.

Although a single burner eye 32, 34 is shown on each clamshell 24, 26, more than one burner eye may be provided on one or both of the clamshells 24, 26. In the embodiment shown in the drawing, each of the burner eyes 32, 34 includes a cooking grate 36, 38 mounted around and partly over the respective burner eye 32, 34. As is known in the art, cooking grates, such as the cooking grates 36, 38, provide a platform on which a pot or other cooking vessel may be placed when heated by the respective burner eye 32, 34. In accordance with an embodiment, the platform is provided by a series of prongs 40, 42.

Figure 5:
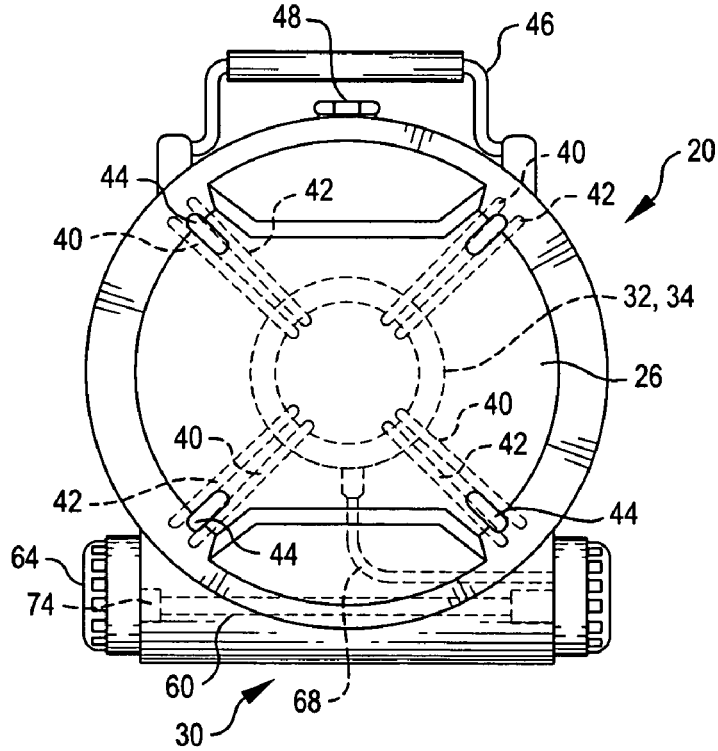
FIG. 5 is a side view of the folding stove of FIG. 1.
Figure 3:
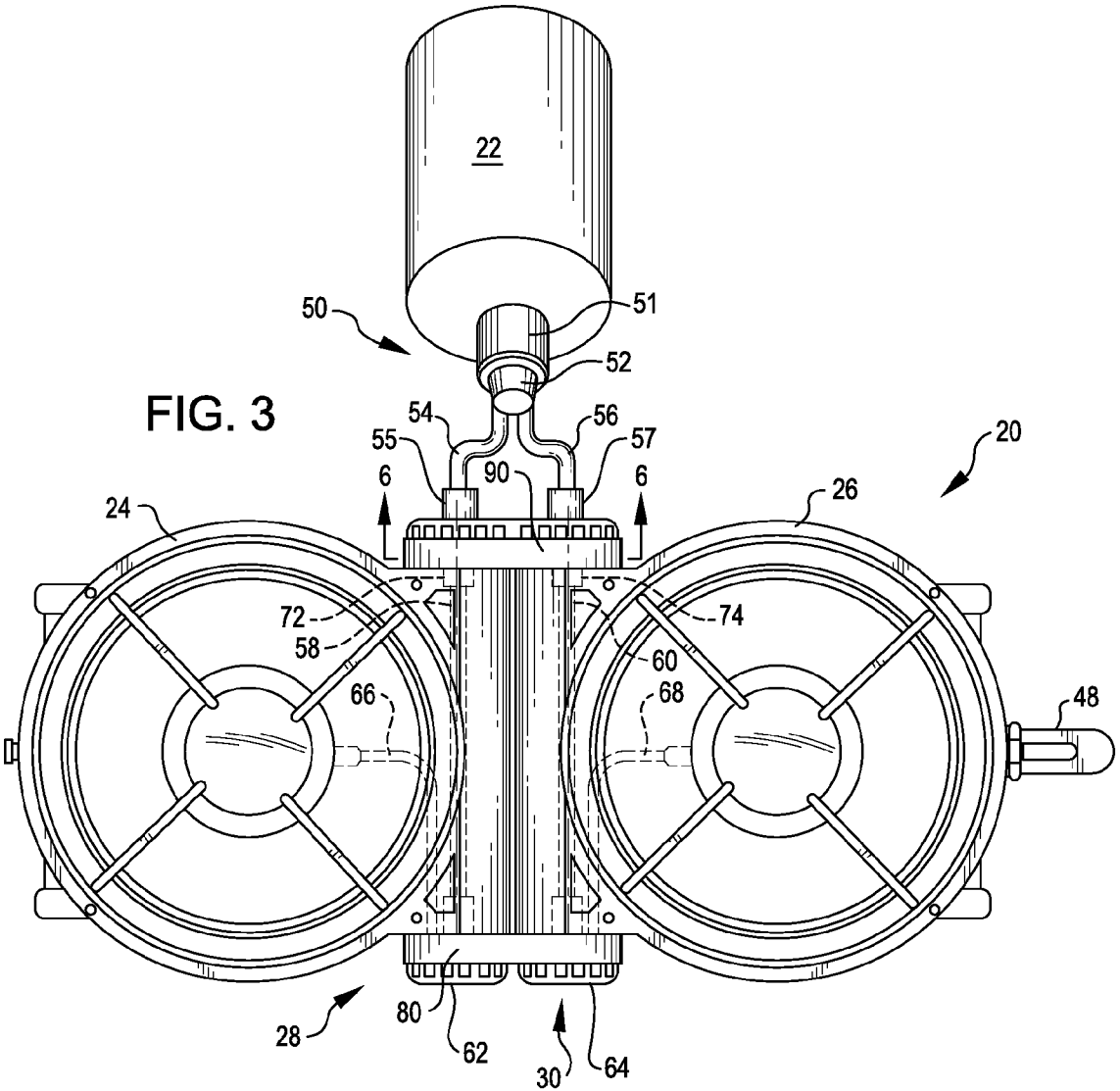
FIG. 3 is a top view of the folding stove of FIG. 2.

The prongs 40, 42 for each of the burner eyes 32, 34 are similar to conventional prongs for burner eyes, but in the embodiment shown, each prong 40 on the clamshell 24 is offset slightly relative to the counterpart prong 42 on the other clamshell 26. That is, each prong 40 is positioned so that when the folding stove 20 is folded into the compact configuration in FIG. 1, the prong does not engage the prong 42 on the opposite clamshell, but instead extends adjacent to the prong 42, and thus is slightly offset relative to the other prong. The slight offset may be, for example, one quarter of an inch or another sufficient amount to provide nesting of the two cooking grates 36, 38, when the clamshells 24, 26 are folded to the compact configuration shown in FIG. 1. The slight offset of the prongs 40, 42 can be seen from the top view in FIG. 3, and the nesting of the prongs 40, 42 can be seen in phantom in FIG. 5. This nesting effect provides more compact storage of the folding stove 20, yet, by not providing a significant offset, a symmetrical appearance is maintained for the cooking grates 36, 38, as can be seen in FIG. 3.

The folding stove 20 includes feet 44 on the rearward surfaces of the clamshells 24, 26. In addition, handles, such as handles 46, may be provided at an outer portion of the clamshells 24, 26. In the embodiment shown in the drawings, the handles 46 are positioned so that they are hinged from a top portion of the folding stove 20 when the folding stove is in the compact configuration of FIG. 1. A latch, such as a latch 48, may be provided for temporarily locking the folding stove 20 in the compact configuration.

In accordance with an embodiment, a regulator and manifold assembly 50 is provided for supplying gas from a canister, such as the gas canister 22, to the two fuel trains 28, 30. The regulator and manifold assembly 50 includes a regulator 51. Regulators are known in the burning appliances art and in general are designed to drop the fuel pressure from the high pressure of a fuel canister, such as the gas canister 22, to an operating pressure for a stove or another gas-operated appliance.

The regulator 51 is connected to a manifold 52. The manifold 52 splits the low pressure fuel stream exiting the regulator 51 into two conduits 54, 56. These two conduits 54, 56 each include a coupling 55, 57, for attaching onto appropriate structures (described below) at the ends of the fuel trains 28, 30. The regulator and manifold assembly 50 is shown attached in this manner in FIG. 3.

The two conduits 54, 56, when attached about the couplings 55, 57, are in fluid communication with internal fuel conduits 58, 60 that extend along the fuel trains 28, 30. The internal fuel conduits 58, 60 in an embodiment are straight pipes that extend co-axially with a rotational axis for each of the clamshells 24, 26. In an embodiment, the couplings 55, 57 are attached to the fuel trains 28, 30 in a manner such that the fuel trains 28, 30 may freely rotate relative to the couplings without gas loss. Such couplings are known in the art, and may be provided, for example by quick release couplings, such as are disclosed in U.S. Pat. No. 2,784,987, although many different couplings may be used.

Control knobs 62, 64 are mounted on the ends of the internal fuel conduits 58, 60 opposite the attachment of the couplings 55, 57. The control knobs 62, 64 are accessible from the outside of the folding stove 20. The control knobs 62, 64 include valves (described below) that open and close and regulate a flow of fuel provided from the internal fuel conduits 58, 60, and into gas flow lines 66, 68 which lead to the burner eyes 32, 34, respectively.

As can be seen in FIG. 6, the internal fuel conduits 58, 60 attach to probes 72, 74, which are configured for attachment to the couplings 55 of the regulator and manifold assembly 50. The probes 72, 74 are fitted within openings of the outer walls of the clamshells 24, 26, and are permitted to float freely therein. Allowing the probes to float freely permits longitudinal displacement of the fuel conduits 58, 60, allowing for manufacturing tolerances and/or expansion of the metal.

In accordance with an embodiment, a linkage, in the embodiment shown, a linkage 90 is provided for spacing the two fuel trains 28, 30, and permitting free rotation of these fuel trains 28, 30 relative to one another. In the embodiment shown, the linkage 90 receives the rear portion of the probes 72, 74, and is mounted for free rotation on surfaces 82, 84 of the probes 72, 74. The surfaces 82, 84 may be defined, for example, between the shoulders 76, 78 on the probes 72, 74 and a pair of lock nuts 86, 88. However, other structures may be provided that allow free rotation of the linkage 90 relative to the fuel trains 28, 30. For example, in the shown embodiment, the linkage 90 is rotatably mounted to the probes 72, 74, but the linkage may be attached at other locations to the fuel train. In addition to free rotation, the linkage 90 also maintains a constant spacing of the fuel trains 28, 30. To this end, the linkage 90 in one embodiment includes holes for receiving the probes 72, 74, so that the probes and the fuel trains 28, 30 may be rotated relative to the linkage but may not be moved outward or inward relative to one another.

Another linkage 80 (FIG. 7) may be provided at the opposite end for similarly spacing and allowing free rotation of the fuel trains 28, 30. If desired, the internal fuel conduits 58, 60 may be attached in a different manner at the opposite end, such as by anchoring the end to the internal fuel conduits 58, 60, because free flotation is not needed at both ends. The linkage 80 may be configured and arranged to recess a portion of the control knobs 62, 64.

Figure 7:
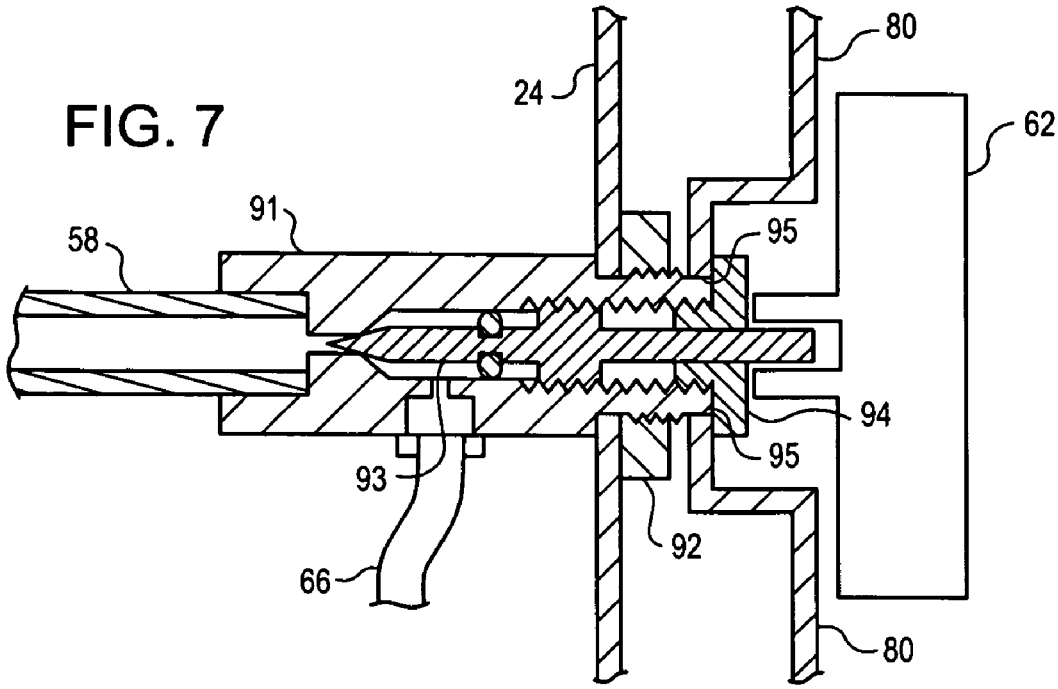
FIG. 7 is a cross-sectional view taken along the section lines 7-7 of FIG. 3.

For example, as shown in FIG. 7, the internal fuel conduit 58 may attach to a valve body 91, which in turn is anchored to the casing for the clamshell 24 by a jam nut 92. A valve stem 93 is positioned in the valve body 91 and is held in position by a stem nut 94. As is known, the control knob 62 rotates to move the valve stem 93 and open flow of fuel between the internal fuel conduit 58 and the gas flow line 66.

The linkage 80 is positioned between a shoulder 95 on the valve body 91 and the stem nut 94, and is free to rotate relative to the valve body in much the same manner that the other linkage 90 is free to rotate.

The linkages 80, 90 permit free rotation of the fuel trains 28, 30 along with the associated clamshells 24, 26. In this manner, when one of the clamshells, for example the clamshell 24, is rotated, the associated fuel train 28 and its internal fuel conduit 58 and gas flow line 66 all rotate with, and are fixed for movement with, the clamshell 24. Thus, there are no parts of the fuel train 28 that have to flex or move relative to the clamshell 24 during pivoting or rotation of the clamshell 24. Thus, no flexible lines or other structures to accommodate bending are required for the fuel train 28, reducing costs and simplifying routing of the fuel through the clamshell 24. Also, as is described above, the connection of the regulator and manifold assembly 50 via the coupling 55 to the fuel train 28 permits rotation without loss of fuel. Thus, the gas canister 22 and the regulator and manifold assembly 50 may remain stationary while rotation of the clamshell 24 is performed, with rotation between the regulator and manifold assembly 50 and the clamshell 24 being performed at the coupling 55. Similarly, the clamshell 26 and its associated fuel train 30 permit rotation of that side of the folding stove 20.

The folding stove 20 provides a variety of options for arrangement of the folding stove 20 during use. For example, one clamshell, such as the clamshell 26, may be folded upward while the other clamshell 24 extends substantially parallel to the ground. The fuel train 28, because it is fixed for rotation with the clamshell 24, allows pivoting of the clamshell 24, but still consistent combustion from the burner eye 32 in the clamshell 24.

The folding stove 20 may be configured in other ways, such as in the configuration shown in FIG. 4, where the clamshell 24 is hanging downward relative to a table. This configuration provides stability for the folding stove 20, but uses a minimal amount of table space. In the embodiment shown, the folding stove 20 extends so that the clamshells 24, 26 form an angle greater than 180 degrees. However, if desired, a stop or stops may be provided to prevent rotation beyond 180 degrees.

Because the two clamshells 24, 26 may be pivoted but still provide consistent combustion, the folding stove 20 may be used on an uneven surface. This feature permits great flexibility for use and arrangement of the folding stove 20.

The regulator and manifold assembly 50 provides cost savings in that only a single regulator 51 is needed for two separate fuel trains, i.e., the fuel trains 28, 30. Moreover, gas is split outside of the folding stove 20, at the manifold 52. In this manner, a gas line does not have to extend between the two pivotable clamshells 24, 26.

Figure 9:
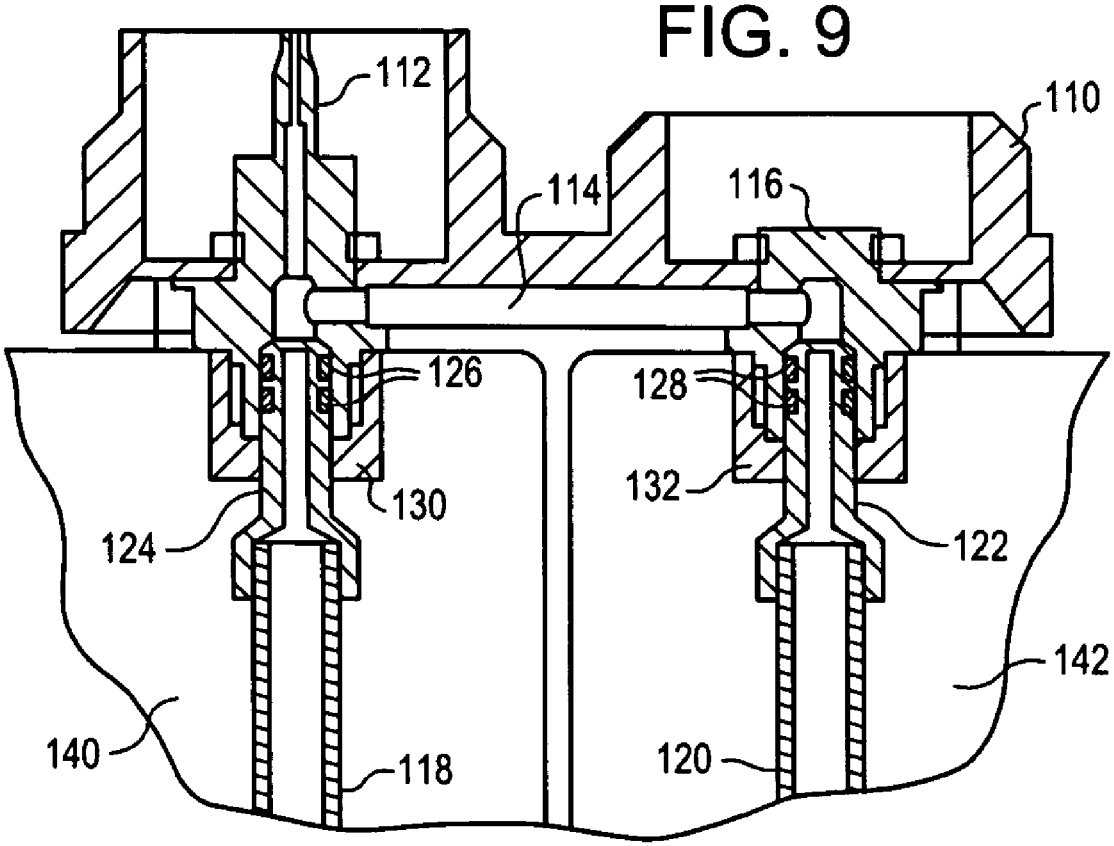
FIG. 9 is an alternate embodiment of a fuel train system for the folding stove of FIG. 1.

As an example of another alternate embodiment, a fuel train system for both of the clamshells 24, 26 may be connected to a single conduit leading from the cylinder 22. Such an embodiment is shown in FIG. 9. A linkage 110 shown in FIG. 9 includes a single probe 112 mounted at one side. This probe 112 includes an outer portion that is configured for connection to a connector that leads to a regulator, not shown but described in the previous embodiment. A fixed tube 114 extends between the probe 112 and a socket 116 on the opposite side of the linkage 110. The socket 116 and the probe 112 are fixed within the linkage 110. The tube 114 is also fixed within the linkage 110, and provides fluid communication between internal chambers of the probe 112 and the socket 116.

Like the previous embodiment, two fuel tubes 118, 120 extend along pivot points for the clamshells of this embodiment. Each of the fuel tubes 116, 120 includes an end piece 122, 124 that is arranged to fit within the socket 116 and the probe 112, respectively. The end pieces 122, 124 each include a pair of o-rings 126, 128 that provide a leak-proof connection of the end piece to the respective probe 112 or socket 116. Nuts 130, 132 fit over and outside a portion of the probe 112 and the socket 116 to secure them to the clamshells 140, 142, respectively.

During use, the o-rings 126, 128 permit the fuel tubes 118, 120 to rotate relative to the linkage 110 when either of the clamshells is rotated relative to the linkage. During this rotation, the o-rings 126, 128 maintain leak-proof fluid communication between the fuel tubes 118, 120 and the probe 112 and the socket 116. In this manner, fuel may be supplied to the probe 112, and that fuel may travel into the fuel tubes 118, 120 regardless of the orientation of the clamshells, and without leakage as a result of movement of the clamshells. Valves (not shown) may be provided on the opposite end of the fuel trains, which may be used to control burners for each of the clamshells.

The embodiment shown in FIG. 9 has an advantage over the previously described embodiment in that only a single connection is needed to the fuel canister 22. This feature permits greater flexibility in connecting a fuel source to the fuel trains.

Because the clamshells 24, 26 pivot along their fuel trains 28, 30, and the couplings 55, 57 attach at the pivot points, the connection of the couplings 55, 57 is the only portion of the fuel supply chain from the canister 22 to the burners 32, 34 that experiences rotation during pivoting of one or both of the clamshells 24, 26. Thus, the fuel trains 28, 30 are simplified in that they do not have to be designed to permit rotation with respect to the clamshells.

The dual pivoting function of the two clamshells 24, 26 permits compact storage of the folding stove 20. In addition, as described above, the offset of the cooking grates 36, 38 relative to one another permits compact storage of the folding stove 20.

The embodiment shown includes rounded clamshells 24, 26. In accordance with an embodiment, the outer portions of the clamshells 24, 26 extend outward beyond the control knobs 62, 64 and the rear linkage 90. In this manner, the outer surfaces of the clamshells 24, 26 may provide protection for the fuel trains 28, 30 and the control knobs 62, 64. In addition, because the folding stove 20 is more slender in the central portion that includes the fuel trains 28, 30 than at outer portions, there is less material for the fuel trains 28, 30, reducing the cost of production of the folding stove 20.

Figure 8:
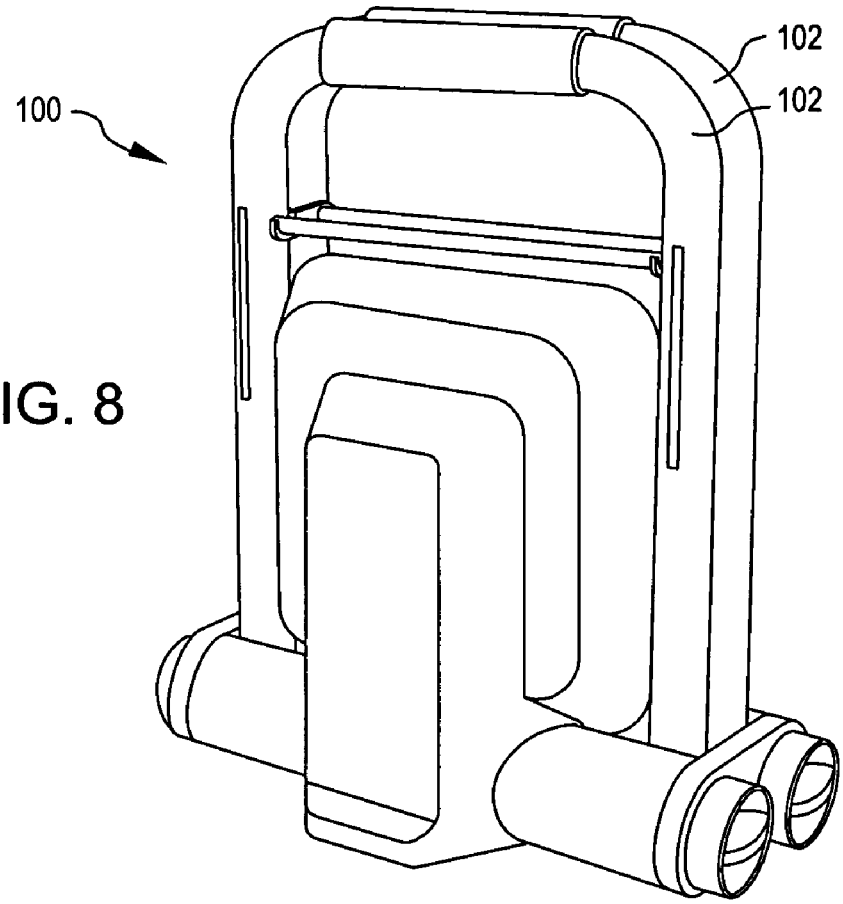
FIG. 8 is a side perspective view of an alternate embodiment of a folding stove in accordance with the present invention.

Alternate embodiments may be utilized. For example, in FIG. 8 a folding stove 100 is shown having a square instead of circular configuration. In this embodiment, tubes 102 extend around the stove 100 and form handles at the upper portion thereof.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A stove, comprising:

a first clamshell having a first cooking surface, a first burner assembly, and a first fuel train connected to the first burner assembly;

a second clamshell having a second cooking surface, a second burner assembly, and a second fuel train connected to the second burner assembly, the first clamshell and the second clamshell being configurable between a first position in which the cooking surfaces are captured between the first and second clamshells and a second position in which the first and second cooking surfaces are exposed;

a linkage connected to the first clamshell at a first rotatable connection and to the second clamshell at a second rotatable connection;

a fuel supply connector mounted on the linkage for attachment to a fuel source;

a fuel conduit extending from the first rotatable connection to the second rotatable connection and in fluid communication with the fuel supply connector, the fuel conduit remaining connected to the stove in the first and second positions and being within the stove when the stove is in the second position;

a first leak-proof connection for connecting the first fuel train to the fuel conduit, the first leak-proof connection being configured to maintain a leak-proof connection between the first fuel train and the fuel supply conduit when the first clamshell is rotated relative to the linkage; and a second leak-proof connection for connecting the second fuel train to the fuel conduit, the second leak-proof connection being configured to maintain a leak-proof connection between the second fuel train and the fuel supply conduit when the second clamshell is rotated relative to the linkage.

2. The folding stove of claim 1, wherein the first and second fuel trains each comprise a fuel train conduit extending along the respective rotatable connection.

3. The folding stove of claim 2, wherein the fuel train conduits are connected to the fuel supply conduit via at least one o-ring.

4. The folding stove of claim 1, wherein the fuel conduit is rigid.

* * * * *